US008011277B2

(12) United States Patent
Johnson et al.

(10) Patent No.: US 8,011,277 B2
(45) Date of Patent: Sep. 6, 2011

(54) HAND TOOL WITH MULTIPLE BIT STORAGE AND A METHOD FOR USING THE SAME

(75) Inventors: Ronald L. Johnson, San Jose, CA (US); Robert J. Gallegos, Fremont, CA (US); Steven Simas Escobar, San Jose, CA (US); Anders Scot Hudson, Campbell, CA (US); Idriss Mansouri-Chafik Ruiz, San Jose, CA (US); Yugen Patrick Lockhart, Palo Alto, CA (US); Howard Allen Wilson, Santa Clara, CA (US); Eric M. Colton, Torrance, CA (US)

(73) Assignee: Wagic, Inc., Los Gatos, CA (US)

( * ) Notice: Subject to any disclaimer, the term of this patent is extended or adjusted under 35 U.S.C. 154(b) by 0 days.

(21) Appl. No.: 11/803,032

(22) Filed: May 10, 2007

(65) Prior Publication Data

US 2008/0276765 A1 Nov. 13, 2008

(51) Int. Cl.
*B25B 23/16* (2006.01)

(52) U.S. Cl. ..... 81/177.4; 81/490; 81/438

(58) Field of Classification Search ..... 81/177.4, 81/490, 437–439; 206/373–379; D8/85
See application file for complete search history.

(56) References Cited

U.S. PATENT DOCUMENTS

| | | | | |
|---|---|---|---|---|
| 244,309 | A | 7/1881 | Rhodes | |
| 647,528 | A | 4/1900 | Schmidt | |
| 873,363 | A | 12/1907 | Ross | |
| 1,000,900 | A | 8/1911 | Dorsey | |
| 1,172,656 | A | 2/1916 | Yorgensen | |
| 1,337,769 | A | 4/1920 | Hemming | |
| 1,398,583 | A | 11/1921 | Bovee | |
| 1,500,852 | A | 7/1924 | Shepard | |
| 1,530,905 | A | 3/1925 | Nance | |
| 1,559,097 | A | 10/1925 | Hill | |
| 1,753,026 | A | 4/1930 | Rosati | |
| 1,888,222 | A | 11/1932 | Curtis et al. | |
| 1,944,606 | A | 1/1934 | Little | |
| 2,236,333 | A | 3/1941 | Cowles | |
| 2,332,656 | A | 10/1943 | Mirando | 30/22 |
| 2,346,364 | A | 4/1944 | Dowe | 279/83 |
| D142,982 | S | 11/1945 | Bloomfield | |
| 2,409,613 | A | 10/1946 | Brooks | 306/32 |
| 2,410,971 | A | 11/1946 | Hartley | |
| 2,465,619 | A | 3/1949 | Veit | 306/32 |
| 2,475,268 | A | 7/1949 | Wittle | 279/14 |
| D156,677 | S | 12/1949 | Smith | D17/14 |

(Continued)

FOREIGN PATENT DOCUMENTS

| | | |
|---|---|---|
| CA | 1 147 176 | 5/1983 |

(Continued)

*Primary Examiner* — D. S Meislin
(74) *Attorney, Agent, or Firm* — Haverstock & Owens LLP

(57) ABSTRACT

A hand tool and bit storage device configured to allow easy storage and access to a wide variety of bits. The hand tool comprises a body portion, a stem portion and a bit interface. The hand tool couples with the storage device. The storage device holds one or more tool frames or bit inserts each comprising a plurality of bits. The bit inserts are deformable to allow easy access to the bits contained therein. In some embodiments, the bit inserts may be locked in the storage device.

21 Claims, 6 Drawing Sheets

U.S. PATENT DOCUMENTS

| | | | | |
|---|---|---|---|---|
| D157,154 | S | 2/1950 | Horton | D58/11 |
| 2,509,507 | A | 5/1950 | Kane | |
| 2,512,967 | A | 6/1950 | Quiron | 145/50 |
| 2,530,024 | A | 11/1950 | Moody | 206/17 |
| 2,532,636 | A | 12/1950 | Minnich | 206/16 |
| 2,569,069 | A | 9/1951 | Motel | 145/50 |
| 2,590,307 | A | 3/1952 | Gibson | |
| 2,593,828 | A | 4/1952 | Arey | 81/177 |
| 2,604,211 | A | 7/1952 | Steine | |
| 2,701,052 | A | 2/1955 | Martel | |
| D175,056 | S | 6/1955 | Wilson | |
| 2,715,028 | A | 8/1955 | Dossie | 279/9 |
| 2,719,042 | A | 9/1955 | Epsy | 279/9 |
| D179,979 | S | 4/1957 | Noga | |
| 2,800,816 | A | 7/1957 | Tasciotti | |
| 2,804,970 | A | 9/1957 | Kuc et al. | 206/16 |
| 2,810,472 | A | 10/1957 | Midkiff | |
| 2,842,020 | A | 7/1958 | Traquinio | 81/177 |
| 2,844,244 | A | 7/1958 | Hanson | |
| 2,854,741 | A | 10/1958 | Cholger | |
| 2,878,701 | A | 3/1959 | Weersma | |
| 3,023,054 | A | 2/1962 | Shigekuni | |
| 3,061,927 | A | 11/1962 | Von Frankenberg Und Ludwigsdorf | 30/156 |
| 3,113,479 | A | 12/1963 | Swingle | 81/177 |
| 3,222,959 | A | 12/1965 | Clark | |
| 3,255,792 | A | 6/1966 | Beck | |
| 3,257,991 | A | 6/1966 | Mosch | 120/1 |
| D205,745 | S | 9/1966 | Nannfeldt | D80/9 |
| 3,424,039 | A | 1/1969 | Scott | |
| 3,592,086 | A | 7/1971 | Derwin | 81/177 A |
| 3,667,518 | A | 6/1972 | Stillwagon, Jr. | |
| 3,707,893 | A | 1/1973 | Hofman | 81/58.1 |
| 3,733,936 | A | 5/1973 | Flynn | 81/58.1 |
| 3,802,286 | A | 4/1974 | Winklhofer et al. | 74/242.11 S |
| 3,863,693 | A | 2/1975 | Carriker | |
| 3,943,801 | A | 3/1976 | Yates | 81/71 |
| 3,958,469 | A | 5/1976 | Meese | |
| 3,997,053 | A | 12/1976 | Bondhus | |
| 4,000,767 | A | 1/1977 | Geng | |
| 4,043,230 | A | 8/1977 | Scrivens | 81/177 A |
| 4,154,125 | A | 5/1979 | Frank | 74/553 |
| 4,196,761 | A | 4/1980 | Royer | |
| 4,227,430 | A | 10/1980 | Jansson et al. | 81/177 M |
| 4,235,269 | A | 11/1980 | Kraus | |
| 4,238,862 | A | 12/1980 | Leatherman | |
| 4,241,773 | A | 12/1980 | Personnat | |
| 4,302,990 | A | 12/1981 | Chrichton et al. | 81/60 |
| 4,308,770 | A | 1/1982 | MacDonald | |
| 4,327,790 | A | 5/1982 | Stevens et al. | |
| 4,384,499 | A | 5/1983 | Shockley | 81/440 |
| D270,024 | S | 8/1983 | Strasser | |
| 4,424,728 | A | 1/1984 | MacDonald | 81/177 |
| 4,448,097 | A | 5/1984 | Rocca | |
| 4,469,109 | A | 9/1984 | Mehl | |
| 4,476,751 | A | 10/1984 | Mishima | |
| 4,525,889 | A | 7/1985 | Dunau | |
| 4,621,718 | A | 11/1986 | DeCarolis | 192/43 |
| 4,699,020 | A | 10/1987 | Bush et al. | |
| 4,703,673 | A | 11/1987 | Allen | |
| 4,711,353 | A | 12/1987 | Rozmestor | 206/378 |
| 4,716,795 | A | 1/1988 | Corona et al. | 81/177.4 |
| 4,716,796 | A | 1/1988 | Corona et al. | 81/177.4 |
| 4,767,006 | A | 8/1988 | Wasem | |
| 4,787,276 | A | 11/1988 | Condon | 81/177.1 |
| 4,815,346 | A | 3/1989 | Littlehorn | |
| 4,819,523 | A | 4/1989 | Souza | |
| 4,819,800 | A | 4/1989 | Wilson | |
| 4,820,090 | A | 4/1989 | Chen | 408/241 R |
| 4,882,841 | A | 11/1989 | Margolis | 30/125 |
| 4,926,721 | A | 5/1990 | Hsiao | 81/177.4 |
| 4,934,223 | A | 6/1990 | Wong | 81/490 |
| D310,770 | S | 9/1990 | Zamarripa | |
| 4,960,016 | A | 10/1990 | Seals | |
| 4,974,477 | A | 12/1990 | Anderson | |
| 4,979,407 | A | 12/1990 | Hernandez et al. | 81/3.09 |
| 5,029,707 | A | 7/1991 | Feng | 206/374 |
| 5,036,975 | A | 8/1991 | Chow | |
| 5,062,173 | A | 11/1991 | Collins et al. | 7/118 |
| 5,063,796 | A | 11/1991 | Gennep | |
| 5,065,487 | A | 11/1991 | Yother | |
| 5,146,815 | A | 9/1992 | Scott, III | 81/437 |
| 5,147,038 | A | 9/1992 | Pergeau | |
| D333,769 | S | 3/1993 | Jureckson | D8/71 |
| D334,516 | S | 4/1993 | Tsunoda | D8/29 |
| D339,048 | S | 9/1993 | Baum | D8/107 |
| 5,263,389 | A | 11/1993 | Frazzell et al. | 81/124.3 |
| 5,265,504 | A | 11/1993 | Fruhm | 81/439 |
| D342,433 | S | 12/1993 | Sorenson | D8/107 |
| 5,271,300 | A | 12/1993 | Zurbuchen et al. | 81/124.4 |
| D343,106 | S | 1/1994 | Eklind et al. | D8/71 |
| 5,295,422 | A | 3/1994 | Chow | |
| 5,320,004 | A | 6/1994 | Hsiao | 81/440 |
| 5,394,984 | A | 3/1995 | Aiba | |
| D359,671 | S | 6/1995 | Acosta | |
| 5,450,774 | A | 9/1995 | Chang | 81/440 |
| 5,461,950 | A | 10/1995 | Iwinski | |
| D365,681 | S | 1/1996 | Chow | |
| 5,495,942 | A | 3/1996 | Izhak | 206/372 |
| 5,499,560 | A | 3/1996 | Aeschliman | |
| 5,499,562 | A | 3/1996 | Feng | 81/177.4 |
| 5,517,885 | A | 5/1996 | Feng | 81/177.4 |
| 5,522,291 | A | 6/1996 | Liu | 81/490 |
| 5,535,882 | A | 7/1996 | Liu | 206/377 |
| D373,943 | S | 9/1996 | Fuhrmann | D8/71 |
| 5,553,340 | A | 9/1996 | Brown, Jr. | 7/118 |
| 5,566,596 | A | 10/1996 | Lin | 81/490 |
| D376,520 | S | 12/1996 | Morin | D8/14 |
| 5,581,834 | A | 12/1996 | Collins | 7/118 |
| D377,444 | S | 1/1997 | Lin | D8/107 |
| 5,592,859 | A | 1/1997 | Johnson et al. | 81/177.4 |
| D378,797 | S | 4/1997 | Poremba et al. | D8/107 |
| D380,131 | S | 6/1997 | Sung | |
| D382,190 | S | 8/1997 | Blackston et al. | D8/107 |
| D383,048 | S | 9/1997 | Sorensen et al. | D8/107 |
| 5,662,013 | A | 9/1997 | Lin | 81/490 |
| D385,172 | S | 10/1997 | Bramsiepe et al. | D8/83 |
| D386,955 | S | 12/1997 | Jones et al. | |
| D388,609 | S | 1/1998 | Chan | |
| 5,711,042 | A | 1/1998 | Chuang | 7/138 |
| D394,794 | S | 6/1998 | Vasudeva | D8/107 |
| 5,758,870 | A | 6/1998 | Weaver | |
| 5,765,247 | A | 6/1998 | Seber et al. | 7/128 |
| 5,791,211 | A | 8/1998 | Bondhus et al. | 81/440 |
| 5,803,584 | A | 9/1998 | Chung | |
| D400,775 | S | 11/1998 | Hsu | D8/107 |
| 5,855,274 | A | 1/1999 | Piao | |
| D405,335 | S | 2/1999 | Lin | D8/82 |
| D408,253 | S | 4/1999 | Rowlay | D8/83 |
| 5,911,799 | A | 6/1999 | Johnson et al. | 81/177.4 |
| 5,916,277 | A | 6/1999 | Dallas | 7/128 |
| 5,918,513 | A | 7/1999 | Ho | |
| 5,970,828 | A | 10/1999 | Bondhus et al. | 81/440 |
| D415,946 | S | 11/1999 | Tsai | D8/107 |
| 5,983,759 | A | 11/1999 | Turner | |
| 5,992,626 | A | 11/1999 | Anderson | 206/378 |
| D418,731 | S | 1/2000 | Rowlay et al. | D8/85 |
| D420,885 | S | 2/2000 | Lin | D8/107 |
| D426,449 | S | 6/2000 | Eklind | D8/107 |
| D426,450 | S | 6/2000 | Eklind | D8/107 |
| D427,875 | S | 7/2000 | Chiu | D8/105 |
| 6,089,133 | A | 7/2000 | Liao | |
| 6,092,656 | A | 7/2000 | Ernst | |
| 6,095,018 | A | 8/2000 | Schuster | |
| 6,105,767 | A | 8/2000 | Vasudeva | |
| 6,128,981 | A | 10/2000 | Bondhus et al. | 81/440 |
| D433,613 | S | 11/2000 | Jialin | |
| D433,910 | S | 11/2000 | Oliver et al. | |
| 6,151,998 | A | 11/2000 | Fu-Hui | |
| D435,415 | S | 12/2000 | Johnson et al. | D8/71 |
| 6,164,172 | A | 12/2000 | Huang | 81/490 |
| D435,773 | S | 1/2001 | Lin | D8/83 |
| D437,541 | S | 2/2001 | Hermansen et al. | D8/105 |
| D437,763 | S | 2/2001 | Oliver et al. | |
| 6,206,189 | B1 | 3/2001 | Huot, Jr. et al. | |
| 6,233,769 | B1 | 5/2001 | Seber et al. | 7/128 |

| | | | | |
|---|---|---|---|---|
| 6,237,451 | B1 | 5/2001 | Wei | |
| 6,279,434 | B1 | 8/2001 | Brown | |
| 6,295,903 | B1 | 10/2001 | Tipper et al. | 81/489 |
| 6,305,248 | B1 | 10/2001 | Rowlay | 81/62 |
| 6,311,587 | B1 | 11/2001 | Johnson et al. | 81/177.4 |
| 6,314,838 | B2 | 11/2001 | Wall | |
| 6,318,218 | B1 | 11/2001 | Anderson et al. | |
| 6,332,381 | B1 | 12/2001 | Vasudeva | |
| 6,345,557 | B1 | 2/2002 | Kuo | |
| D454,766 | S | 3/2002 | Lin | |
| 6,382,057 | B1 | 5/2002 | Kienholz | |
| 6,389,931 | B1 | 5/2002 | Delaney et al. | |
| 6,397,709 | B1 | 6/2002 | Wall | |
| 6,405,620 | B2 | 6/2002 | Liao | |
| D459,967 | S | 7/2002 | Johnson et al. | D8/71 |
| 6,427,564 | B1 | 8/2002 | Nelson | |
| 6,490,954 | B2 | 12/2002 | Johnson et al. | 81/177.4 |
| 6,510,767 | B1 | 1/2003 | Rivera | |
| D472,712 | S | 4/2003 | Sagen | |
| 6,564,680 | B1 | 5/2003 | Rinner et al. | |
| 6,598,503 | B1 | 7/2003 | Cunningham | 81/177.4 |
| 6,675,678 | B2 | 1/2004 | Liu | |
| 6,698,318 | B2 * | 3/2004 | Peters | 81/177.4 |
| 6,739,224 | B1 | 5/2004 | Wershe | |
| 6,752,046 | B1 | 6/2004 | Lee | |
| 6,758,350 | B2 | 7/2004 | Lin | |
| 6,763,744 | B2 | 7/2004 | Johnson et al. | 81/177.4 |
| 6,799,490 | B1 | 10/2004 | Chu | |
| 6,898,998 | B2 | 5/2005 | Shyu | |
| 6,901,826 | B2 | 6/2005 | Huang | |
| 6,922,870 | B2 | 8/2005 | Tontz, Sr. | |
| 6,925,910 | B2 | 8/2005 | Alford | |
| 6,928,908 | B1 | 8/2005 | Yu | |
| 6,935,211 | B2 | 8/2005 | Chen | |
| 6,941,843 | B2 | 9/2005 | Johnson et al. | |
| 6,948,406 | B1 | 9/2005 | Li | |
| 6,968,758 | B2 | 11/2005 | Lin | |
| 7,028,593 | B1 | 4/2006 | Lin et al. | |
| 7,051,626 | B1 | 5/2006 | Chen et al. | 81/438 |
| 7,051,629 | B2 | 5/2006 | Huang | |
| D523,637 | S | 6/2006 | Chang | |
| 7,066,061 | B1 | 6/2006 | Chen et al. | 81/439 |
| 7,073,418 | B2 | 7/2006 | Kuo | |
| 7,086,314 | B2 | 8/2006 | Wannop | |
| 7,093,519 | B1 | 8/2006 | Huang | |
| D527,903 | S | 9/2006 | Chan | |
| 7,100,476 | B1 | 9/2006 | Feit | |
| 7,131,358 | B2 | 11/2006 | Hsien | |
| 7,143,669 | B2 | 12/2006 | Hu | |
| 7,150,208 | B2 | 12/2006 | Debley | |
| 7,159,260 | B2 | 1/2007 | Hansen | |
| 7,159,491 | B1 | 1/2007 | Chaconas et al. | |
| 7,165,479 | B1 | 1/2007 | Lee | |
| D548,464 | S | 8/2007 | Lin | |
| 7,284,466 | B1 | 10/2007 | Ho | |
| D557,099 | S | 12/2007 | Lin | |
| 7,305,908 | B2 * | 12/2007 | Chi et al. | 81/177.4 |
| 7,467,574 | B1 | 12/2008 | Lin | |
| 7,467,575 | B2 | 12/2008 | Lai | |
| 7,565,852 | B2 | 7/2009 | Yu | |
| 2003/0047474 | A1 | 3/2003 | Dahlson | |
| 2003/0126957 | A1 | 7/2003 | Huang | |
| 2003/0226428 | A1 | 12/2003 | Liu | |
| 2004/0050218 | A1 | 3/2004 | Napoli | |
| 2004/0173061 | A1 | 9/2004 | Liou | |
| 2004/0262344 | A1 | 12/2004 | White | |
| 2005/0011318 | A1 | 1/2005 | Tsai | |
| 2005/0229752 | A1 | 10/2005 | Nickipuck | |
| 2005/0247587 | A1 | 11/2005 | Holland-Letz | |
| 2006/0101955 | A1 | 5/2006 | Chang | 81/490 |
| 2006/0118500 | A1 | 6/2006 | Chen | |
| 2006/0288823 | A1 | 12/2006 | Schepman | |
| 2007/0023306 | A1 | 2/2007 | Lai | |
| 2007/0151402 | A1 | 7/2007 | Schneeman et al. | |
| 2007/0221017 | A1 | 9/2007 | Heaven | |
| 2007/0245862 | A1 | 10/2007 | Gonzalez et al. | |
| 2007/0295171 | A1 | 12/2007 | Johnson et al. | |
| 2008/0128370 | A1 | 6/2008 | Shih | |
| 2008/0148909 | A1 | 6/2008 | Lai | |
| 2008/0156754 | A1 | 7/2008 | Cheng | |
| 2008/0164171 | A1 | 7/2008 | Meng | |
| 2008/0190249 | A1 | 8/2008 | Yu | |
| 2008/0202963 | A1 | 8/2008 | Liao | |
| 2008/0251402 | A1 | 10/2008 | Chiu | |
| 2008/0271573 | A1 | 11/2008 | Lown et al. | |
| 2009/0107303 | A1 | 4/2009 | Steinweg et al. | |

FOREIGN PATENT DOCUMENTS

| | | | | |
|---|---|---|---|---|
| DE | 24 53 480 | A1 | 5/1976 | |
| DE | 37 44 176 | A1 | 8/1989 | |
| EP | 856233 | | 12/1960 | |
| EP | 503 559 | A1 | 9/1992 | |
| EP | 618 046 | A1 | 10/1994 | |
| FR | 787512 | | 9/1935 | 5/4 |
| JP | 55045442 | U | 3/1980 | |
| JP | 57-13165 | | 1/1982 | |
| JP | 3-47775 | | 5/1991 | |
| JP | 4-29368 | | 3/1992 | |
| JP | 5-31882 | | 4/1993 | |
| WO | WO 83/01406 | | 4/1983 | |
| WO | WO 97/29887 | | 8/1997 | |

* cited by examiner

HAND TOOL WITH MULTIPLE BIT STORAGE AND A METHOD FOR USING THE SAME

FIELD OF THE INVENTION

The present invention relates to hand tools capable of being used with multiple bits. More specifically, the present invention relates to a screwdriver removably coupled with a storage device which holds multiple driver bits, allows easy access to the bits and provides a method of using the screwdriver for projects requiring multiple bits.

BACKGROUND OF THE INVENTION

Carpenters, electricians, mechanics, other skilled workers and even lay people rely on a wide variety of tools to complete their work. Various tools and bits are frequently needed by these workers including screwdrivers, slotted screws, Phillips-Head screws and connections, pozidriv bits, torx bits, allen wrenches and screws, hex key bits, Robertson bits, tri-wing bits, torq-sets, spanner bits, drill bits, sockets of various shapes and sizes and the like.

Furthermore, the above-listed tools are needed in various sizes. For example, an automobile mechanic might need to loosen a large slotted screw. To achieve enough torque to loosen a large slotted screw, a large slot screwdriver is needed. However, this screwdriver would be useless to the same mechanic who wanted to loosen the tiny screws of a car audio system.

Tools requiring bits typically utilize a "loose bit" solution. According to this solution, a hand tool or similar tool is separate from the bit holder containing bits. Workers face several problems with this configuration due to the many components and the hassle corresponding to the methods of accessing them.

According to the "loose bit" solution, the user must set down the hand tool, pick up the bit holder with one hand, use the other hand to choose and access a desired bit from the bit holder, set down the bit holder and finally couple the selected bit to the hand tool. This traditional method of changing bits requires many parts, many steps and many motions.

Alternatively, a user of a "loose bit" tool system might attempt to hold the numerous tools simultaneously, for example, the driver, the bit holder, the current bit, the replacement bit, etc, as well as holding work pieces. This practice often times results in a load that is too heavy or awkward for the user to work dexterously and in a constant potential to drop one of these components. Finally, it is particularly difficult to perform the tasks required according to the "loose bit" solution while on a ladder or in other positions requiring great precision or balance.

Next, when utilizing a "loose bit" method, a user cannot conveniently test a bit for the proper fit with a screw or other work piece. Rather, the user must guess what size is appropriate, and then access bit after bit from a "loose bit" bit holder until the correct bit is found without a convenient way to "test fit" a bit.

Also, organizing all these tools is time consuming and takes up space. Furthermore, many tools come in both American and metric sizes. For example a ¼ inch allen wrench is very close in size to a 6 mm allen wrench. However, the two cannot be used interchangeably, requiring two sets of nearly identical wrenches. Next, tools are expensive and a carpenter can spend a lot of money buying the multiple screwdrivers, allen wrenches and other tools which are needed to do even a single job. Furthermore, traditional tool boxes and shelving can store many screwdrivers, wrenches and bits, but they do not provide an easy way to locate particular bits within the box.

SUMMARY OF THE INVENTION

A hand tool with a storage device is disclosed. In some embodiments of the invention, a ratchet is included on the hand tool. The ratchet alternatively allows either clockwise or counterclockwise rotation. In some embodiments of the present invention, a magnet is included on the hand tool's bit interface to provide strength to the interface. The hand tool is removably coupled to a bit storage device. The bit storage device holds bit inserts, which hold individual bits. In some aspects of the present invention, the hand tool itself accommodates bit inserts. In some embodiments of the present invention, the bit storage device holds multiple bit inserts. In some embodiments of the present invention, the bit storage device or the bit inserts are labeled according to the contents therein. The bit inserts are configured to bend and distort to more easily access the stored bits contained therein. The hand tool and bit insert are configured such that a user is able to access the bit insert, remove bits from the hand tool with the bit insert, access and couple a new bit from the bit insert to the hand tool, all without setting any pieces aside, allowing for fewer steps and motions and reducing the potential for dropping or losing bits. In some embodiments of the present invention, a locking system is utilized to keep the bit inserts in place. A finger grip allows a user easier access to the bit inserts in the storage device and allows a user to squeeze the grip

BRIEF DESCRIPTION OF THE DRAWINGS

The novel features of the invention are set forth in the appended claims. However, for the purpose of explanation, several embodiments of the invention are set forth in the following figures.

DETAILED DESCRIPTION

For the purpose of this disclosure, the word bit shall refer to any tool, device, accessory or the like which is normally associated with hand tools, wrenches, drills or the like, including, but not limited to, slotted screws, Phillips-Head screws and connections, pozidriv bits, torx bits, allen wrenches and screws, hex key bits, Robertson bits, tri-wing bits, torq-sets, spanner bits, drill bits, sockets of various shapes and sizes or the like.

Figure 1A:
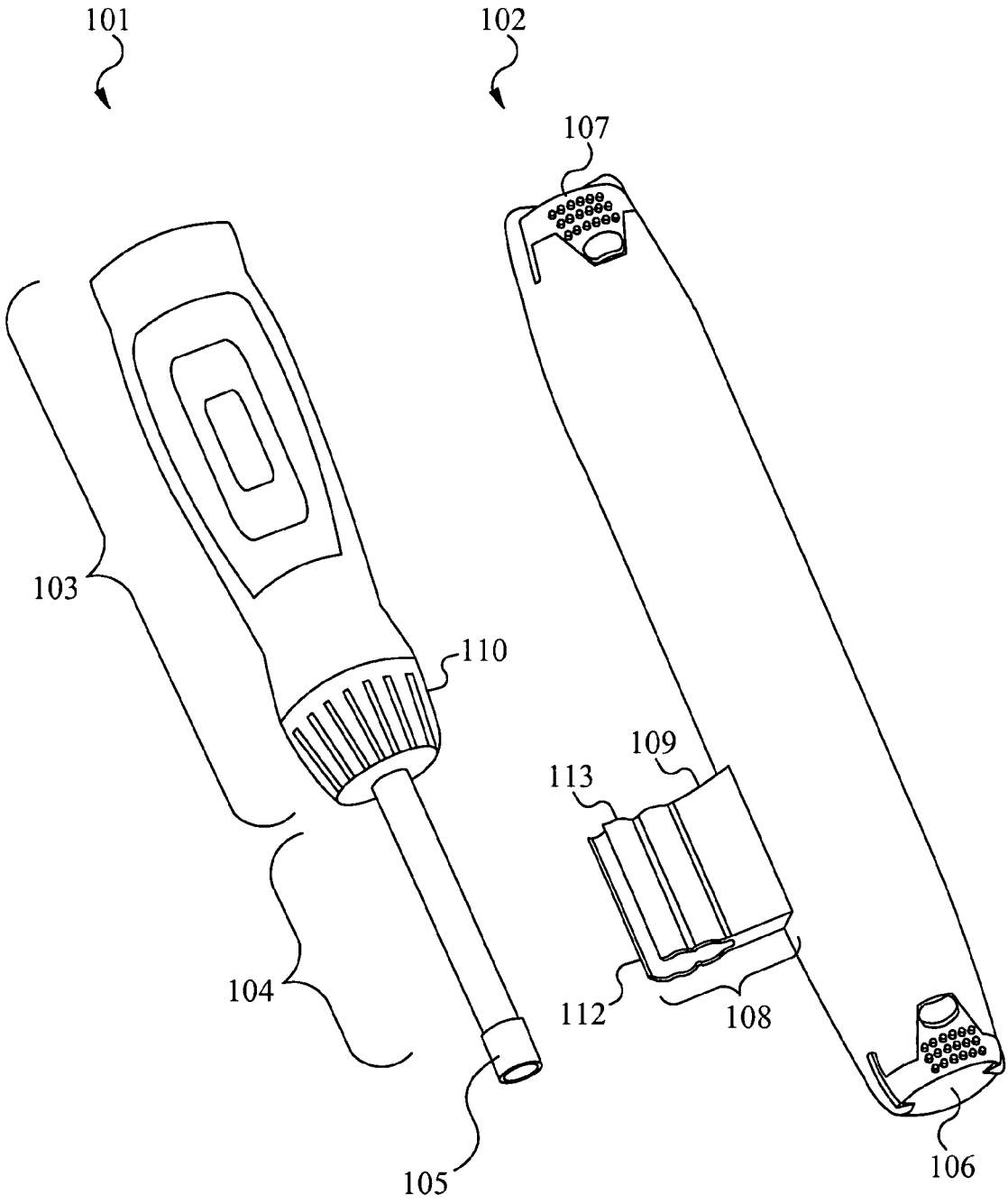
FIG. 1A illustrates a perspective view of the hand tool and bit storage device according to one embodiment of the present invention.

FIG. 1A provides a perspective view of a hand tool 101 and a bit storage device 102 according to some embodiments of the present invention. The hand tool 101 has a body portion 103, a stem portion 104 and a bit interface 105.

The body portion 103 is designed to comfortably fit in a user's hand and also to provide torque on the bit interface in an amount needed for common applications in carpentry, electronics, mechanics and the like. The stem portion 104 is coupled to the body portion 103 and to the bit interface 105. In some embodiments of the present invention, the stem portion 104 is thinner than the body portion 103 to allow the stem portion 104 and the bit interface 105 to fit into smaller spaces than the body portion 103 in order to access work pieces, while still allowing the user to exert adequate torque on the work pieces from a distance.

In some embodiments of the present invention, the hand tool also includes a ratchet device (not shown) and a ratchet housing 110. The ratchet housing 110 rotates around the axis of the stem portion 104 by some arc to toggle between clockwise and counterclockwise driving. When the ratchet housing 110 is positioned at one end of the arc, the ratchet allows the stem portion 104 and the bit interface 105 to rotate in the clockwise direction, thus driving standard screws or tightening standard bolts. In such a position, a counter-clockwise rotation does not turn the stem portion 104. When the ratchet housing 110 is positioned at the other end of the arc, the ratchet allows the stem portion 104 and the bit interface 105 to rotate in the counter-clockwise direction, thus retracting standard screws or loosening standard bolts. In such a position, a clockwise rotation does not turn the stem portion 104.

The bit storage device 102 includes a fixture 108. The stem portion 104 of the hand tool 101 couples with a bit storage device with a fixture 108. As shown, the fixture 108 is a pressure fixture comprised of two flanges 112, 113 extending from the base 109 of the fixture 108. However, it will be appreciated by those skilled in the art that other means for coupling the hand tool to the bit storage devices are contemplated including, but not limited to straps, slots, hook and loop fasteners, snaps, and tongue and groove configurations. In other embodiments, the hand tool 101 and bit storage device 102 are not coupled, but are each designed to fit into an especially designed carrying case, box or pouch.

The bit storage device 102 is a substantially hollow structure with two removable storage tools 106, 107 inserted within the structure. The removable storage tools hold bits (not shown) which couple with the bit interface 105. The hand tool with accessory storage according to the embodiment shown in FIG. 1A allows the user to access a hand tool 101 and easily access and change bits (not shown) as dictated by the project being worked on.

Figure 1B:
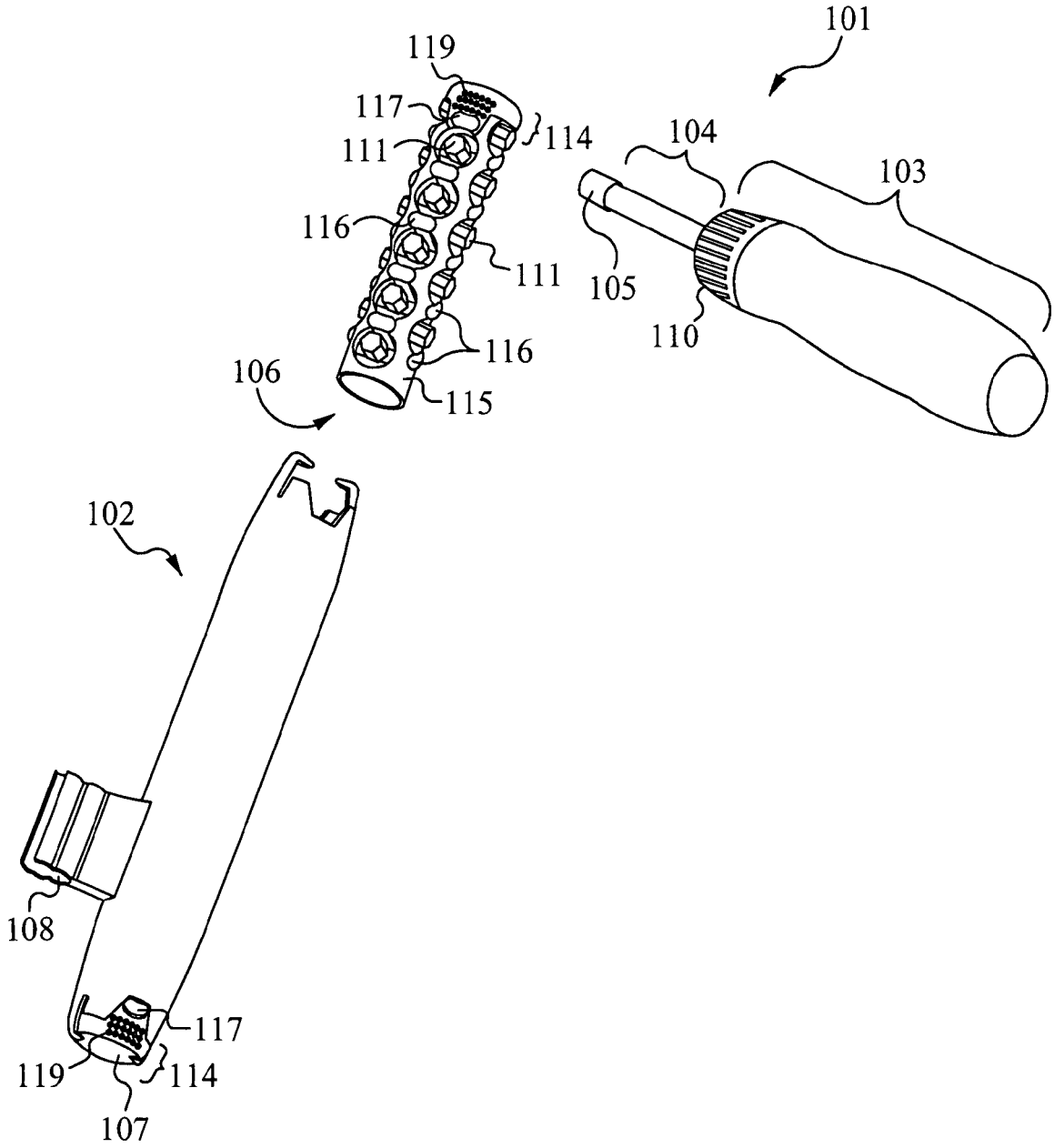
FIG. 1B illustrates a perspective view of the hand tool and bit storage device with hand tool interacting with a removed bit insert.

FIG. 1B shows the hand tool 101 and bit storage device 102 with the removable bit storage tool 106 removed. The removable bit storage tool 106 contains a number of bits 111. As shown, the bits 111 each have hexagonal interfaces for interfacing with the bit interface 105. It will be apparent to those skilled in the art that other shapes for interfacing between the bits and bit interface is contemplated. In some embodiments of the present invention, a 6.6 mm hex bit interface is used. In other embodiments, a 0.25 inch hex bit interface is used. Although specific sizes and shapes for the bit interface have been disclosed, it will be readily apparent to those skilled in the art that any other sizes and shapes for the bit interface are contemplated.

FIG. 1B also shows the storage tool frame cap 114 on the bit storage tool 106. The storage tool frame cap 114 is slightly larger than the circumference of the bit storage tool 106 so that a user can easily grip the frame cap 114. The storage tool frame cap 114 also has protrusions 119 situated on its surface to provide friction to a user accessing the storage tool frame cap 114. Furthermore, the storage tool frame cap 114 is coupled to a cap node 117. The cap node 117 aides in retaining the bits 111 within the bit storage tool 106, as will be explained in more detail when referring to FIG. 4.

Figure 2A:
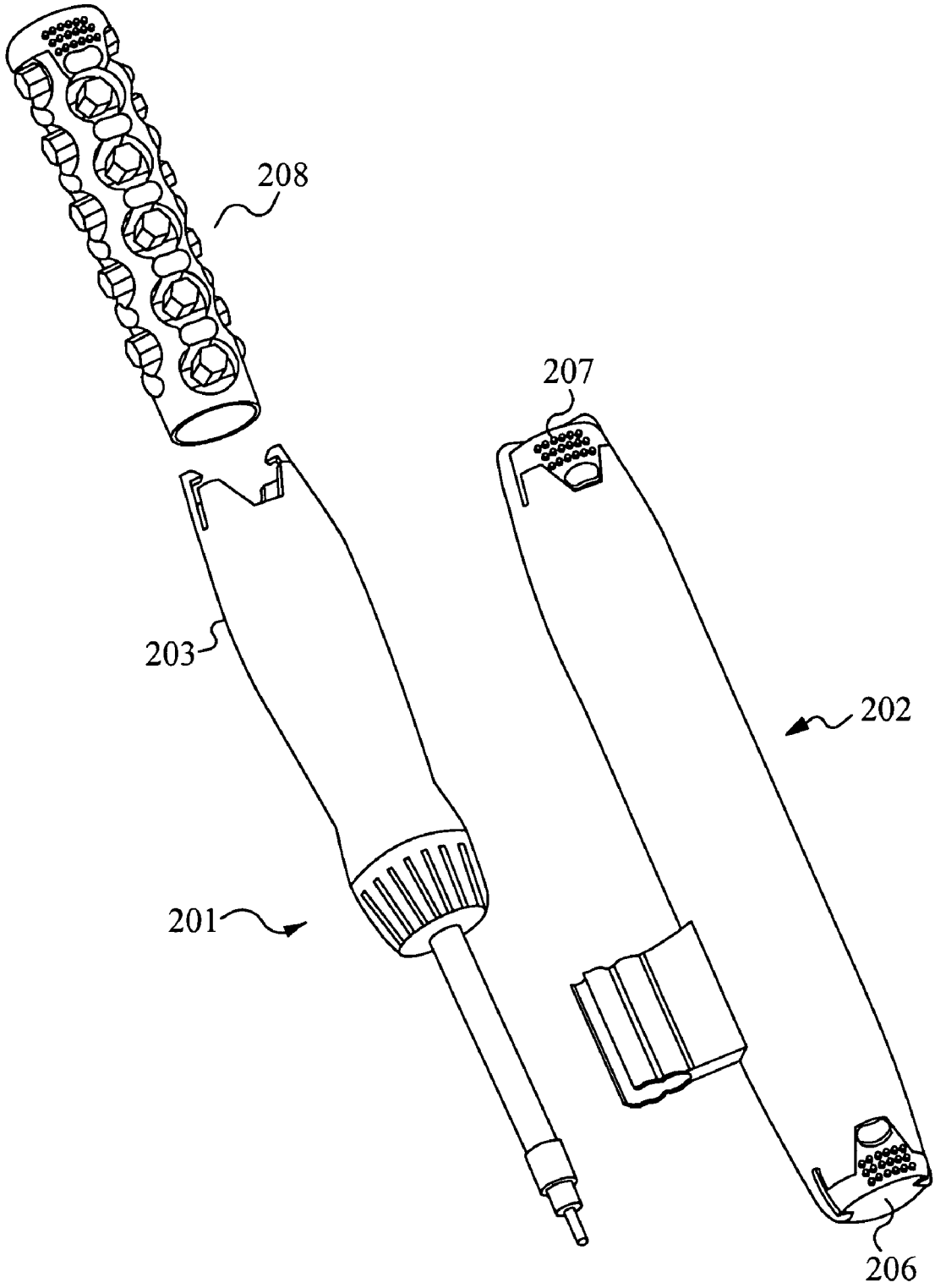
FIG. 2A illustrates a perspective view of the hand tool and bit storage device according to another embodiment of the present invention.

FIG. 2A provides a perspective view of another embodiment of the present invention with a hand tool 201 which accommodates a removable bit storage tool 208 and a bit storage device 202. In this embodiment, the body 203 of the hand tool 201 is substantially hollow and accommodates a removable bit storage tool 208. As shown, the bit storage device 202 holds the removable bit storage tools 206 and 207. However, the removable bit storage tools 206, 207 and 208 are interchangeable and are able to be held within either the storage device 202 and the body 203.

Figure 2B:
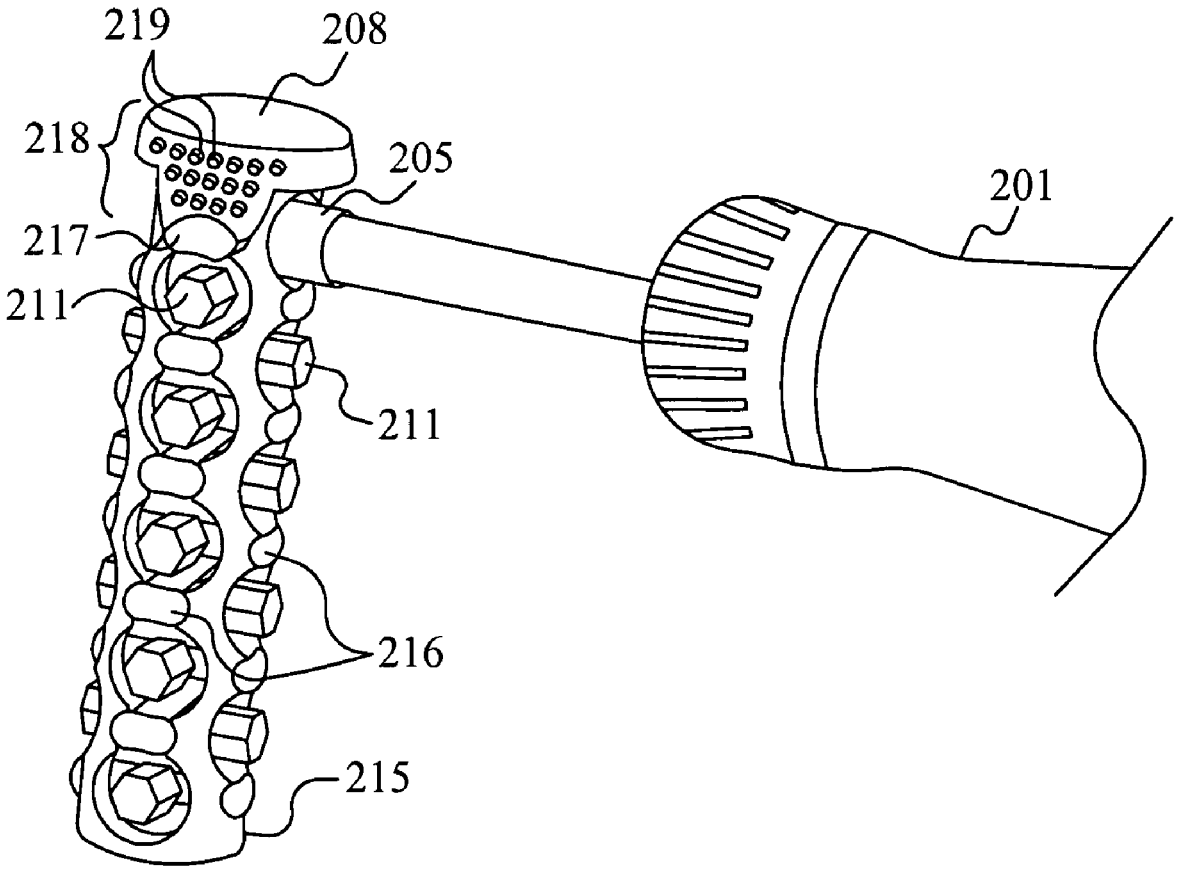
FIG. 2B illustrates a close up view of the bit insert and bit interface according to some embodiments of the present invention.

FIG. 2B shows details of the removable bit storage tool 208. The basic structure of the bit storage tool 208 is a semi-rigid polymer, which forms the frame 215 of the storage tool 208. The frame 215 is connected in spots by nodes 216. In some embodiments, the nodes 216 are more flexible than the frame 215. In the preferred embodiment, the nodes 216 are comprised of a resilient polymer. The frame 215 is connected by the nodes 216 to form a number of holes to accommodate the bits 211. The bits 211 are inserted into the holes and are held in place through friction exerted on the bits by the frame 215 and the nodes 216. It is preferred that a certain threshold of force be applied to the bits 211 to remove them from the bit storage tool 206. This threshold is preferably greater than the bits' 211 force due to gravity and also small forces created by normal jostling of the bit storage tool 208.

To remove the bits 211 from the bit storage tool 208, a user is able to manually push the bit from the side of the frame 215. Alternatively, a user is able to use the hand tool 201 itself as a bit insertion and extraction means. Using the hand tool 201 as a bit insertion and extraction means simply requires a user to hold the bit storage tool 208 with one hand and insert the bit interface 205 coupled with a bit into an empty portion of the frame 215 with the other. The user is then able to pull the hand tool out of the frame 215 while leaving the bit coupled to the frame 215. Additionally, to couple the hand tool 201 with a bit, a user is able to access a bit 211 from the frame 215 by coupling the bit interface 205 with a bit 211 and pulling the bit 211 from the frame 215.

These features give the user the ability to install and remove bits 211 directly from the bit insert frame 215 without ever putting down the hand tool 201 and without having to reach for a bit holder. This features allows the interchanging of bits in fewer steps, with fewer motions and with less of a risk of losing or dropping bits. As such, this configuration is superior to "loose bit" systems which require additional steps and present additional challenges, as described above.

In some embodiments, a user is able to squeeze one or more nodes 216 adjacent to a particular bit to aid in removing the bit from the frame 215. Squeezing the nodes 216 causes the shape of the frame 215 and the shape of the holes to distort. Such distortion allows easier access to the bits 211.

Another flexible polymer node comprises a cap node 217 coupled to a finger grip 218 at the top of the bit storage tool 206. The surface of the finger grip 218 contains a number of protrusions 219 to ensure friction between the user's finger and the finger grip 218. Squeezing the cap node 217 distorts the shape of the top of the bit storage tool 208, allowing easier removal of the bit storage tool 208 from the bit storage device 202. The bit storage tools 206 and 207 (FIG. 2A) is also removable from the bit storage device 202, and bits are likewise removable from bit storage tools 206 and 207 in a similar manner.

FIG. 2B also illustrates how the hand tool 201 with the bit interface 205 interfaces with the bit storage tool 208 and the bits 211. The bit interface 205 is designed to fit tightly over the bit 211. In some embodiments of the present invention, the bit interface 205 contains a magnetic core. The magnetic core creates a stronger bond between the bit 211 and the bit interface 205. The magnets chosen for the magnetic core may be selected from among: Ferrite Magnets, Neodymium Magnets, Samarium-cobalt Magnets, Ceramic Magnets and Alnico Magnets, among others. The user is able to push the bit 211 from the other side of the frame 215 to remove the bit 211 or can put pressure on a node 216 adjacent to the bit, as described above.

Furthermore, both ends of the bits 211 are able to be seen accessed from the sides of the bit storage tool 208. As such, a user can "test fit" the bit 211 with a particular screw or other work piece without first removing the bit 211 from the frame 215. This feature further saves the user the time required to fit a screw or other work piece of an unidentifiable size with the correct bit.

In some embodiments, each bit storage tool houses a different type of bit such as: slotted bits, phillips bits, pozidriv bits, torx bits, hex key bits, robertson bits, tri-wing bits, torq-sets, spanner bits or star bits. According to this embodiment, three different types of bits are stored and immediately accessible to the user of one tool.

Figure 3:
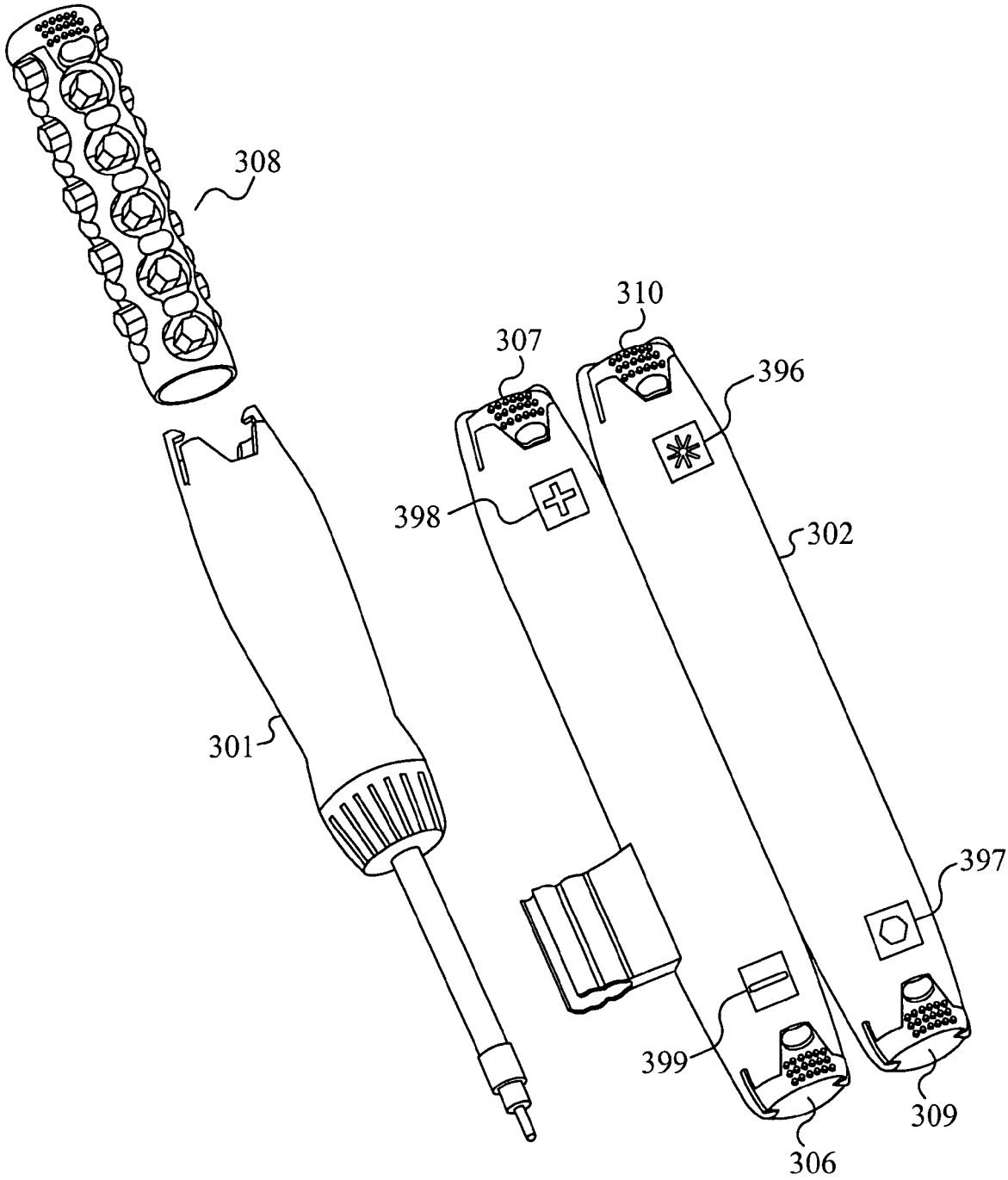
FIG. 3 illustrates a perspective view of the hand tool and bit storage device according to yet another embodiment of the present invention.

FIG. 3 provides a perspective view of yet another embodiment of the present invention. Here, a hand tool 301 with a removable bit storage tool 308 couples with a bit storage device 302. The bit storage device 302 holds four bit storage tools 306, 307, 309, 310. As such, the embodiment shown is able to store five bit storage tools allowing a user to have a very wide variety of tools immediately accessible. In some embodiments, pictures, words, symbols, colors or similar identifying markings are marked on the body of the bit storage device and depict the contents of each of the bit storage tools. FIG. 3 depicts symbols on the body of the bit storage device which depicts the contents therein. Symbol 399 shows that bit storage tool 306 contains slotted screw bits. Symbol 398 shows that bit storage tool 307 contains Phillip's head screw bits. Symbol 397 shows that bit storage tool 309 contains allen bits. Symbol 396 shows that bit storage tool 310 contains star bits.

In other embodiments of the present invention, markings on the body of the bit storage device or on the body portion of the hand tool indicate whether the bits contained therein are either American sized or metric.

Figure 4:
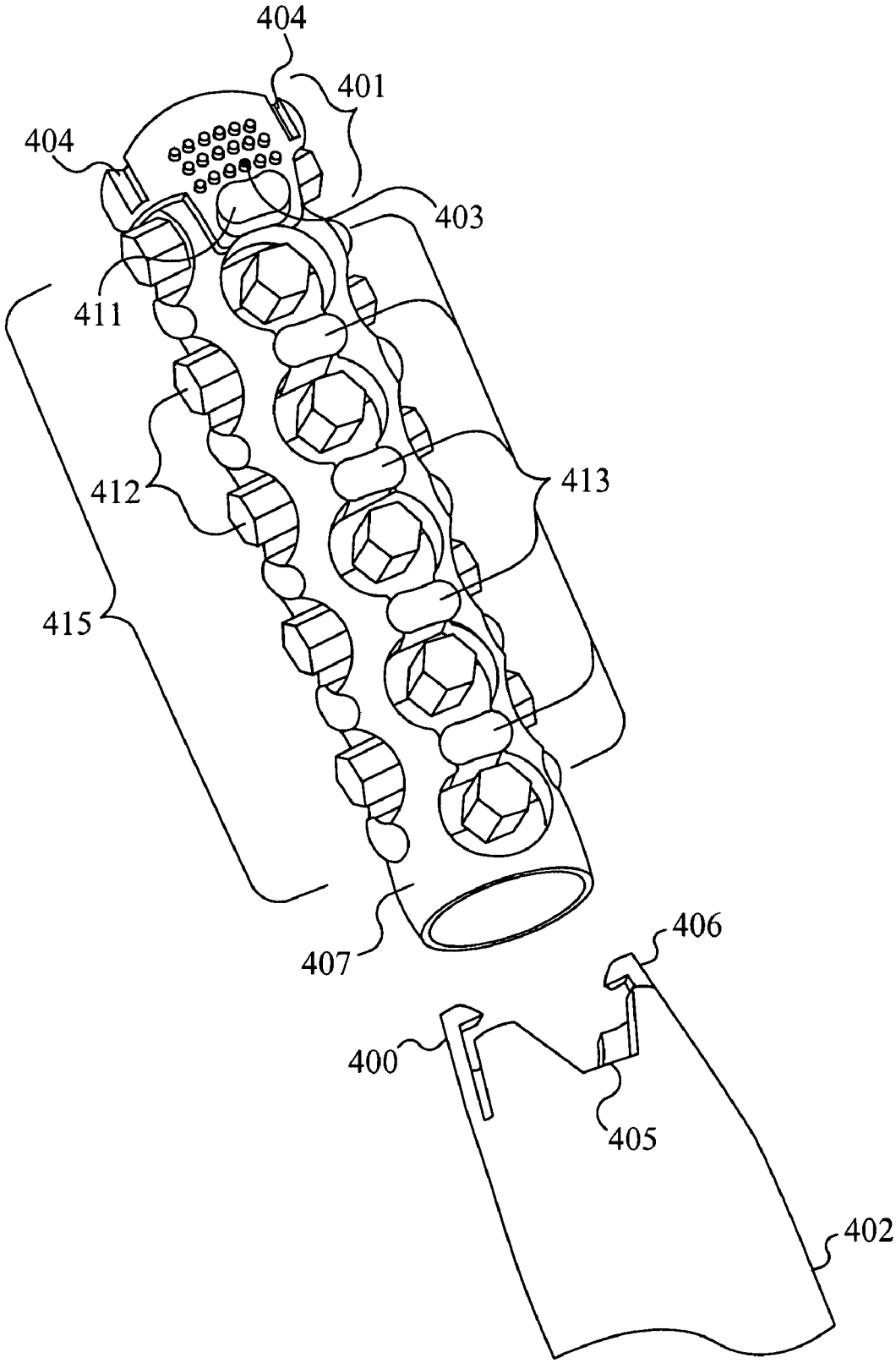
FIG. 4 illustrates a perspective view of the locking system used with the hand tool and bit storage device according to some embodiments of the present invention.

FIG. 4 illustrates another embodiment of the present invention in which the removable bit storage tools lock into the bit storage device or the hand tool. In FIG. 4, a close up of a removable bit storage tool 407 is shown entering a bit storage device 402. The bit storage tool 407 has a frame portion 412 and a frame cap 401 with finger grip protrusions 403. The frame cap 401 which protrudes further out than the rest of the frame portion 412. Adjacent to frame cap 401 are cap nodes 411.

The bit storage device 402 has an opening to hold the bit storage tool 407. The opening in the bit storage device 402 contains spaces 405 to accommodate the nodes 411 of the frame cap 401. Further, the opening features two semi-flexible and resilient clips 406. When the bit storage tool 407 is inserted into the bit storage device, the bit storage tool 407 passes over the rounded ends of the clips 406, causing the clips 406 to bend out. When positioned correctly, the clips 406 fit into the grooves 404 when the bit 407 is fully inserted, thereby locking the bit storage tool 407 into the bit storage device 402.

In some embodiments, the cap nodes 411 help a user insert bits into the frame 415 and remove bits 412 from the frame 415. According to these embodiments, the cap nodes 411 are composed of a more flexible material than the rest of the upper portion 401. In the preferred embodiment, the cap nodes 411 are comprised of a resilient polymer. When pressure is applied to the cap nodes 411, the shape of frame 415 and the shape of the nodes 413 distort, causing the holes to change shape. As pressure is applied or removed from the cap nodes 411, the holes are either tightened or loosened. When the holes are tightened, a user is able to exert enough force on the bits 412 from the bit interface (not shown) to couple the bit 412 to the bit interface from one side of the frame without forcing the bit 412 to come out the other side of the frame 415. A user is then able to release some pressure from the cap node 411, causing the holes to loosen. When the holes are loose enough, the user is able to remove the bit 411 from the frame 415 by pulling the bit interface away from the hole. As such, the cap nodes allow a user to change bits without requiring them to set down the hand tool and use two hands as they do in a "loose bit" application.

The present invention, as disclosed, provides significant advantages over traditional tools and tool storage systems. First, unlike "loose bit" tools, the present invention allows a user to change bits without ever having to put their tool or work pieces aside. Furthermore, the present invention allows a user to change bits with fewer steps and motions and limits the potential for dropping or losing bits.

Furthermore, the present invention cuts down the cost of buying tools. Using the hand tool and bit storage tools and holders of the present invention eliminates the need to purchase individual hand tools with each particular fitting. For example, the present invention eliminates the need for multiple sized flat head hand tools and the need to buy both a flathead and a phillips head hand tool because the present invention is able to hold all of them. For instance, the bit storage tools are able to hold various sized slotted screws, Phillips-Head screws and connections, pozidriv bits, torx bits, allen wrenches and screws, hex key bits, Robertson bits, tri-wing bits, torq-sets, spanner bits, drill bits, sockets of various shapes and sizes or the like. Also, those skilled in the art will appreciate that the removable bit storage tools are able to hold a wide variety of other tools.

The present invention also serves to conserve space and simplify organizing. The need to organize multiple hand tools of various sizes and shapes, allen wrenches, sockets, and the like on a tool bench or in a tool box is eliminated. With the present invention, all the bits required are able to be stored easily and are easily organized in a user friendly fashion. For example, one removable bit storage tool might hold metric sized allen bits and another bit storage tool might hold American sized allen bits. Furthermore, a third removable bit storage tool might hold star bits. The storage tools are able to be labeled with printed words, color-coated, labeled with pictures of the bits they contain, or otherwise identified.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device and method of the present invention could be implemented in several different ways and have several different appearances.

We claim:

1. A tool set comprising:

a hand tool comprising:

a body portion having at least one aperture;

a stem portion coupled to the body portion, and a bit interface coupled to the stem portion;

a bit storage tool holder assembly with at least one extra bit storage aperture; and a bit storage tool comprising a tool frame, wherein the tool frame has at least one hole therethrough holding at least one bit, wherein the at least one bit is removed by pushing the bit through and out one side of the at least one hole or pulling the bit from a second opposite side of the at least one hole, and wherein the tool frame is configured to be removably coupled with either the at least one aperture and the at least one extra bit storage aperture.

2. The tool set according to claim 1, wherein the tool frame comprises at least one node extending into the tool frame.

3. The tool set according to claim 2, wherein the tool frame comprises a plurality of holes and a plurality of nodes, wherein the plurality of holes each houses a bit, and wherein squeezing the plurality of nodes aids in removing a bit.

4. The tool set according to claim 3, wherein the plurality of holes are situated on multiple sides of the tool frame.

5. The tool set according to claim 1, wherein the bit storage tool further comprises a frame cap coupled to the tool frame and a cap node coupled to the frame cap, wherein squeezing the cap node aids in removing a bit.

6. The tool set according to claim 5, the frame cap further comprising a finger grip, wherein the finger grip is textured to provide a secure grip on the frame cap.

7. The tool set according to claim 1, wherein the at least one bit is selected from among slotted bits, Phillips-Head bits, pozidrive bits, torx bits, allen wrench bits, hex key bits, Robertson bits, tri-wing bits, torq-sets, spanner bits, drill bits, and sockets of various shapes and sizes.

8. A tool set comprising:

a hand tool comprising:

a body portion having at least one aperture;

a stem portion coupled to the body portion; and a bit interface coupled to the stem portion;

a bit storage tool holder assembly with at least one extra bit storage aperture; and a bit storage tool comprising at least one bit;

a tool frame, the tool frame comprising:

at least one hole therethrough holding the at least one bit, wherein the at least one bit is removed by pushing the bit through and out one side of the at least one hole or pulling the bit from a second opposite side of the at least one hole; and at least one node extending into the tool frame, wherein squeezing the at least one node aids in removing the at least one bit;

wherein the tool frame is configured to be removably coupled with either the at least one aperture and the at least one extra bit storage aperture;

a frame cap coupled to the tool frame; and a cap node coupled to the frame cap, wherein squeezing the cap node aids in removing a bit.

9. The tool set according to claim 8, wherein the tool frame comprises a plurality of holes and a plurality of nodes, wherein the plurality of holes each houses a bit, and wherein squeezing the plurality of nodes aids in removing a bit.

10. The tool set according to claim 9, wherein the plurality of holes are situated on multiple sides of the tool frame.

11. The tool set according to claim 10, wherein the tool frame is centered about a Y-Y axis, wherein the plurality of holes are successively positioned down a length of the tool frame, wherein the successively positioned plurality of holes are alternatively positioned on lines parallel to an X-X axis and a Z-Z axis, and further wherein the lines pass through the Y-Y axis.

12. The tool set according to claim 8, the frame cap further comprising a finger grip, wherein the finger grip is textured to provide a secure grip on the frame cap.

13. The tool set according to claim 8, wherein the at least one bit is selected from among slotted bits, Phillips-Head bits, pozidrive bits, torx bits, allen wrench bits, hex key bits, Robertson bits, tri-wing bits, torq-sets, spanner bits, drill bits, and sockets of various shapes and sizes.

14. A tool set comprising:

a hand tool comprising:

a body portion having at least one aperture;

a stem portion coupled to the body portion; and a bit interface coupled to the stem portion;

a bit storage tool holder assembly with at least one extra bit storage aperture; and a bit storage tool comprising a plurality of bits; and a tool frame, the tool frame comprising:

a plurality of holes; and a plurality of nodes, wherein the plurality of holes each houses one of the plurality of bits, and wherein squeezing the plurality of nodes aids in removing a bit, and further wherein the plurality of holes are situated on multiple sides of the tool frame;

wherein the tool frame is centered about a Y-Y axis, wherein the plurality of holes are successively positioned down a length of the tool frame, wherein the successively positioned plurality of holes are alternately positioned on lines parallel to an X-X axis and a Z-Z axis, and further wherein the lines pass through the Y-Y axis and further wherein the tool frame is configured to be removably coupled with either the at least one aperture and the at least one extra bit storage aperture.

15. The tool set according to claim 14, the frame cap further comprising a finger grip, wherein the finger grip is textured to provide a secure grip on the frame cap.

16. The tool set according to claim 14, wherein the plurality of bits are selected from among slotted bits, Phillips-Head bits, pozidrive bits, torx bits, allen wrench bits, hex key bits, Robertson bits, tri-wing bits, torq-sets, spanner bits, drill bits, and sockets of various shapes and sizes.

17. A tool set comprising:

a hand tool comprising:

a body portion having at least one aperture;

a stem portion coupled to the body portion; and a bit interface coupled to the stem portion;

a bit storage tool holder assembly with at least one extra bit storage aperture; and a bit storage tool comprising a plurality of bits;

a tool frame, the tool frame comprising:

a plurality of holes; and a plurality of nodes, wherein the plurality of holes each houses one of the plurality of bits, and wherein squeezing the plurality of nodes aids in removing a bit, and further wherein the plurality of holes are situated on multiple sides of the tool frame;

wherein the tool frame is centered about a Y-Y axis, wherein the plurality of holes are successively positioned down a length of the tool frame, wherein the successively positioned plurality of holes are alternately positioned on lines parallel to an X-X axis and a Z-Z axis, and further wherein the lines pass through the Y-Y axis and further wherein the tool frame is configured to be removably coupled with either the at least one aperture and the at least one extra bit storage aperture;

a frame cap coupled to the tool frame, the frame cap comprising a finger grip textured to provide a secure grip on the frame cap; and a cap node coupled to the frame cap, wherein squeezing the cap node aids in removing a bit.

18. The tool set according to claim 17, wherein the plurality of bits are selected from among slotted bits, Phillips-Head bits, pozidrive bits, torx bits, allen wrench bits, hex key bits, Robertson bits, tri-wing bits, torq-sets, spanner bits, drill bits, and sockets of various shapes and sizes.

19. A hand tool comprising:

a body portion having at least one aperture;

a stem portion coupled to the body portion;

a bit interface coupled to the stem portion;

a bit storage holder assembly with at least one extra bit storage aperture that removably couples to the stem portion; and a bit storage apparatus that fits within the bit storage holder assembly comprising a plurality of bits;

a frame, the frame comprising:

a plurality of holes; and a plurality of nodes, wherein the plurality of holes each houses one of the plurality of bits, and wherein squeezing the plurality of nodes aids in removing a bit, and further wherein the plurality of holes are situated on multiple sides of the tool frame.

20. A tool set comprising:

a hand tool comprising:

a body portion having at least one aperture;

a stem portion coupled to the body portion, and a bit interface coupled to the stem portion;

a bit storage tool holder assembly removably coupled to the hand tool with at least one extra bit storage aperture; and a bit storage tool comprising a tool frame, wherein the tool frame has at least one hole therethrough holding at least one bit, and wherein the tool frame is configured to be removably coupled with either the at least one aperture and the at least one extra bit storage aperture.

21. A tool set comprising:

a hand tool comprising:

a body portion having at least one aperture;

a stem portion coupled to the body portion, and a bit interface coupled to the stem portion;

a bit storage tool holder assembly with at least one extra bit storage aperture for removably holding a bit storage tool; and the bit storage tool comprising a tool frame, wherein the tool frame has at least one hole therethrough holding at least one bit, wherein the at least one bit is removed by pushing the bit through and out one side of the at least one hole or pulling the bit from a second opposite side of the at least one hole, and wherein the tool frame is configured to be removably coupled with either the at least one aperture and the at least one extra bit storage aperture.

* * * * *